United States Patent [19]

Weingärtner et al.

[11] 4,450,570

[45] May 22, 1984

[54] VACUUM ARC MELTING AND CASTING FURNACE WITH A VACUUM CHAMBER AND A TILTING CRUCIBLE

[75] Inventors: Ernst Weingärtner, Gelnhausen, Fed. Rep. of Germany; Klaus Samietz, Tokyo, Japan

[73] Assignee: Leybold-Heraeus GmbH, Cologne, Fed. Rep. of Germany

[21] Appl. No.: 435,130

[22] Filed: Oct. 18, 1982

[30] Foreign Application Priority Data

Oct. 17, 1981 [DE] Fed. Rep. of Germany ..... 3141312

[51] Int. Cl.[3] ..... F27D 11/08

[52] U.S. Cl. ..... 373/69; 373/72; 373/102

[58] Field of Search ..... 373/68, 69, 72, 84, 373/102, 45

[56] References Cited

U.S. PATENT DOCUMENTS 2,789,152 4/1957 Ham et al. .
2,958,719 11/1960 Beecher .
4,262,159 4/1981 Grof et al. .

FOREIGN PATENT DOCUMENTS 678414 7/1939 Fed. Rep. of Germany ..... 373/84
2300341 7/1973 Fed. Rep. of Germany ..... 373/72
43010 10/1930 France ..... 373/84

*Primary Examiner*—Roy N. Envall, Jr.
*Attorney, Agent, or Firm*—Felfe & Lynch

[57] ABSTRACT

The invention concerns a vacuum arc melting and casting furnace comprising a vacuum chamber, a tilting crucible and a current connection leading to the bottom of the tilting crucible. This current connection consists of a fixed contact and of a co-operating contact arranged on the bottom of the crucible and movable with the tilting crucible. Also provided is an electrode rod for holding an electrode concentrically in relation to the tilting crucible.

The fixed contact is secured on at least two current conductors which are substantially coaxial with the electrode rod or electrode. These conductors pass through the vacuum chamber from the top and extend past the tilting crucible, and their distance apart is such that the crucible can be tilted between them into the casting position.

10 Claims, 2 Drawing Figures

VACUUM ARC MELTING AND CASTING FURNACE WITH A VACUUM CHAMBER AND A TILTING CRUCIBLE

The invention concerns a vacuum arc melting and casting furnace with a vacuum chamber and tilting crucible.

If, in furnaces of the above-described kind, the current paths in the crucible, i.e. in the melt, do not run concentrically with the crucible, the electrode burns away at one side, i.e. in an oblique manner. If the electrode is of what is known as the fusible kind, asymmetrical fusing takes place because of the lateral deflection of the arc caused by the field-strength distribution. This occurs to a particularly marked extent when the electrical current connection to the crucible is eccentric as with a previously preferred place for connecting the current supply, the axis of tilt of the crucible. The tilt axis is generally in the immediate vicinity of the pouring lip of the crucible. Mobility of the current-supply means is therefore necessary at least at this point.

In order to cause the current path to run substantially concentrically with the electrode and the melting crucible, flexible current cables have also been connected to the middle of the bottom of the crucible while keeping the axis of tilt near the pouring lip, these flexible cables allowing the mobility of the tilting crucible. These flexible cables, which have to carry currents of 20,000 amperes and more and which, in addition, are exposed to a high ambient temperature, are generally designed as hollow cables through which cooling water is caused to flow. Thus, in the event of a leak, the danger of a steam explosion and/or an exothermic chemical reaction arises, the latter when the molten metal, such as titanium for example, is particularly reactive at the high temperatures.

Cables for carrying currents of high strength, and particularly water-cooled cables, have a relatively great minimum radius of bend, so that the vacuum chamber, surrounding the tilting crucible, must be of considerably greater volume to guarantee the necessary mobility of the flexible current cables.

Furnaces of the initially described kind are known from U.S. Pat. Nos. 2,789,152 and 2,958,719.

The furnace in accordance with U.S. Pat. No. 2,789,152 has a flexible current cable, which leads to a central contact at the bottom of the crucible and to which the above remarks apply. Because of an eccentric arrangement of the electrode or electrodes, the tip of the electrode burns off in an oblique manner, through this is of subsidiary importance since the electrode is a permanent electrode and is of extremely small cross-section.

U.S. Pat. No. 2,958,719 discloses the idea of replacing a flexible current-supply to a central contact on the bottom of the tilting crucible by submerging a contact in a pot filled with a metal having a low melting point. However, this contact can be broken only when the contact metal is molten. For this purpose, the known furnace comprises a heating means for the contact. On the other hand, the heat supplied and generated in the contact metal must be dissipated, for which purpose the contact device is provided with a cooling-water circuit. A device of this kind is expensive and still involves the risk of explosion if cooling water escapes.

The known furnaces also have what is called an open current loop, i.e. the heating or melting current is supplied and carried away at points in the furnace that are at a considerable distance from each other so that strong magnetic fields occur which have a deleterious effect upon the travel of the arc. Furthermore, the known furnaces are designed to be supplied exclusively with direct current. An alternating-current supply and a pulsating direct-current supply of mains frequency or above result in high inductive losses, the magnitude of which is directly proportional to the frequency and the size of the current loop. The use of mains frequency suggests itself in view of the low cost of the current supply. However, in order to avoid inductive losses, use has been made of extremely low frequencies in the past, but here again, the use of correspondingly expensive inverters has to be taken into account.

The object of the present invention is, therefore, to improve a vacuum arc furnace of the initially described kind in such a way that it becomes possible to dispense with the use of complicated bottom contacts (flexible cables; liquid metal contacts) and that the furnace has the smallest possible current loop, so that it is possible to supply the furnace with alternating current or pulsating direct current of mains frequency and above, without any appreciable inductive losses occurring.

According to the invention and in the case of the initially described kind of furnace, this object is achieved in that a fixed contact is secured to at least two rigid current conductors which are substantially coaxial with the electrode rod and electrode and extend downwardly through the vacuum chamber and past the tilting crucible in such a way that the tilting crucible can be tilted between them into the casting position.

In contrast to the prior art systems, an arrangement of this kind constitutes a quasi-coaxial disposition of the current-carrying parts. The current paths extend in close proximity in opposite directions, so that the two current loops thus formed circumscribe an area of minimum size. The distance between the two rigid current conductors of the electrode is mainly determined by the diameter of the melting crucible located between the two conductors. This results in minimum inductive losses at a given frequency. Furthermore, the surrounding area outside the current paths is substantially free from magnetic fields, so that the other parts of the equipment cannot become heated up by inductive coupling.

The expression "quasi-coaxial" means that the arrangement concerned does not form a completely coaxial system, which could be achieved only by complementing the two rigid current conductors to form a hollow cylinder which, however, would then interfere with the tilting movement of the crucible. Experience has shown however, that, as a minimum requirement imposed on the coaxial system, the mirror-symmetrical arrangement of two current conductors in relation to the electrode is quite sufficient to meet the requirements imposed.

Because of the rigid form of the current conductors to the fixed contact, it is possible to dispense with flexible current-transmitting elements as well as with liquid metal contacts, as they are called. However, the cooling of rigid bus bars can be planned to give a considerably greater safety factor than in the case of, for example, flexible conductors. The escape of cooling water from a rigid conductor system is extremely unlikely, since no bending loads or fatigue phenomena can occur.

As a result of the substantially coaxial form of the electromagnetic field, the arc burns mainly in the axis of symmetry of the system, i.e. it is not laterally deflected, or if it is, only to a slight extent. The result is an ideal burn-off or fusion behaviour of the electrode, so that the input of heat into the metal in the tilting crucible proceeds from the centre and therefore in a uniform manner.

West German patent publication DE-OS No. 28 33 695 discloses, in the case of an electroslag remelting furnace, the idea of arranging the current conductors quasi-coaxially and of providing one of the contacts on the bottom of the mould. However, the furnace concerned is of a quite different kind and does not comprise a vacuum chamber or a tilting crucible, so that no problems regarding a tilting movement of the crucible are anticipated. Furthermore, there are no difficulties at all as regards the requirement of passing the rigid current conductors through the vacuum chamber.

The subject-matter of the present invention provides the further advantage that the supply of current to the conductors can take place at almost any required point, including the cover on the upper part of the furnace. A particularly advantageous form of construction of the subject-matter of the invention is characterized in that the coaxial current conductors are interconnected, below the tilting crucible, by a transverse member, which is substantially parallel to the axis of tilt and in which the fixed contact is arranged, and in that the movable co-operating contact can be moved laterally into engagement with the fixed contact by means of the tilting crucible when the crucible is swung into the melting position.

As a result of this step, the current conductors in conjunction with the transverse member have the effect of a frame which constitues a specific stop for limiting the tilting movement of the crucible. At the same time, the contact on the base of the tilting crucible and the fixed co-operating contact act as a switch. The crucible can be removed in an extremely simple manner.

Further advantageous forms of the subject-matter of the invention are set forth in subsidiary claims.

DESCRIPTION OF THE DRAWINGS

An example of the form of construction of the subject-matter of the invention will now be described in greater detail by reference to FIGS. 1 and 2, in which.

DESCRIPTION OF THE PREFERRED EMBODIMENTS

Figure 1:
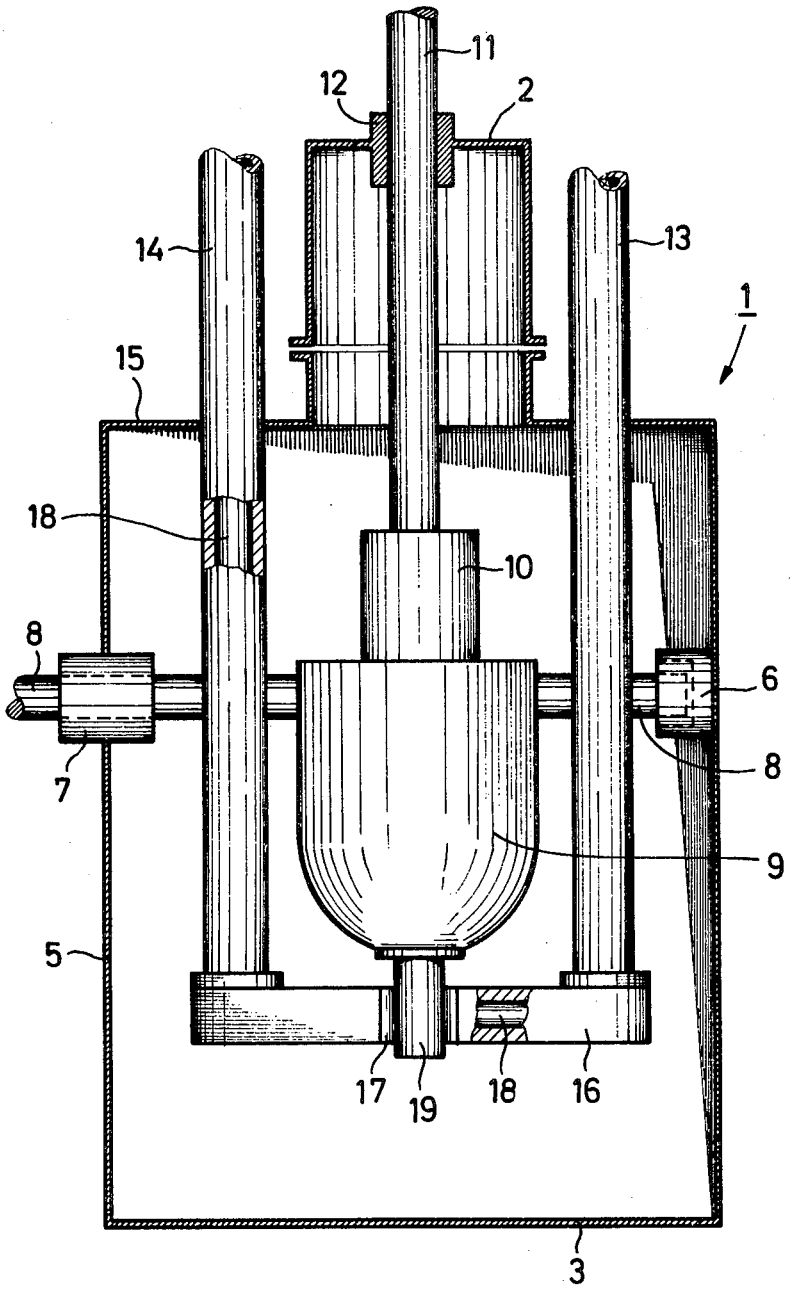
FIG. 1 is a side view of the components of the furnace, with the vacuum chamber shown in vertical section.

FIG. 1 illustrates a vacuum chamber 1, which consists of an upper furnace part 2 and a lower furnace part 3. The construction of vacuum chambers of this kind and their connection with a vacuum pump unit, not shown, form part of the prior art, so that further details do not require to be described.

The lower part 3 of the furnace has two lateral chamber walls 4 and 5, to which are secured pivot bearings 6 and 7 for a shaft 8 extending through the chamber wall 5; a tilting crucible 9 is connected to the shaft to rotate therewith. The axis of the shaft 8 is therefore the axis of tilt of the crucible 9.

The equipment is illustrated in the operating position. Located within the tilting crucible and concentric therewith is an electrode 10, which is made of a fusible metal. The electrode 10 is secured to an electrode rod 11 which, by way of an insulating vacuum grommet 12 extends through the upper part 2 of the furnace. By means of this vacuum grommet and the electrode rod 11, the electrode 10 can be fed into the furnace at the rate at which it is consumed.

Arranged in a mirror-symmetrical manner in relation to the tilting crucible 9, the electrode 10 and the electrode rod 11, are two rigid current conductors 13 and 14 which extend parallel to the electrode rod 11. At the top, the current conductors pass through the cover 15 of the lower part 3 of the furnace and are connected to a current-supply unit, not illustrated. The lower ends of the current conductors 13 and 14 are disposed below the lowest point of the tilting crucible 9. Here the two current conductors are interconnected by a transverse member 16 which is substantially parallel to the axis of the tilt and in which a fixed contact 17 is provided. A cooling duct system 18 is provided in the current conductors 13 and 14 as well as in the transverse member 16.

Arranged on the bottom of the crucible and concentrically with the tilting crucible 9, is a co-operating contact 19 which is movable with the crucible and takes the form of a cylinder; when the crucible is tilted, the co-operating contact 19 can be swung laterally out of the contact 17.

One pole of the current-supply unit, not illustrated, is connected in parallel with the two current conductors 13 and 14, whereas the other pole is connected to the electrode rod 11. Quasi-coaxial current supply is achieved in this way.

Figure 2:
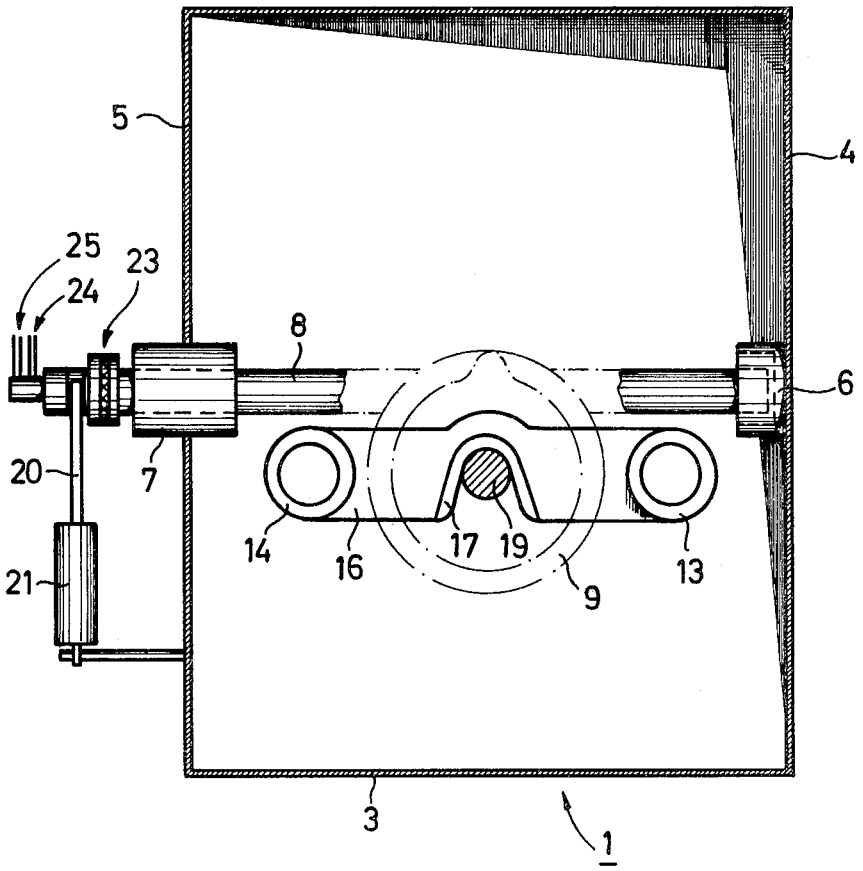
FIG. 2 is an underneath plan view of the FIG. 1 subject-matter, with the vacuum chamber shown in horizontal section.

In FIG. 2, parts that are similar to those of FIG. 1 carry the same reference symbols as in the latter Figure. In particular, the form of the transverse member 16 and of the fixed contact 17 can be seen. It can also be seen that the fixed contact 17 also forms a means for limiting the swinging movement of the tilting crucible 9 when the latter moves back from its casting position into the illustrated melting position upon rotation of the shaft 8. It will also be observed that the shaft 8 is connected, by way of an eccentrically connected piston rod 20, to a pressurized-medium cylinder 21, which bears against the chamber wall 5 through an arm 22. The piston rod 20 and the pressurized-medium cylinder 21 form what is known as a rotary drive for the shaft 8, the connection with the shaft 8 being by way of an insulating intermediate member 23, which is clamped between two flanges, not shown in detail. The rotary drive also comprises contactors, not shown, which act as position indicators and/or produce control signals.

The shaft 8 is provided with coolant ducts, not shown, through which cooling ducts, not illustrated but known per se, in the tilting crucible 9, are supplied. FIG. 2 shows only the outer connections 24 and 25 of the coolant circuit.

The current conductors 13 and 14 as well as the transverse member 16 are made of copper and are interconnected in an efficient current-conducting manner. The fixed contact 17 as well as its co-operating contact 19 are replaceably connected to the components associated with each of them.

We claim:

1. A vacuum arc melting and casting furnace with a vacuum chamber consisting of an upper part and a lower part, and with a tilting crucible and a non-breakable central current connection, which leads to the bottom of the tilting crucible and consists of a fixed contact and a co-operating contact which is arranged on the bottom of the crucible and is movable with the crucible, the furnace also having an electrode rod for holding an electrode concentric with the tilting crucible and for guiding the electrode, characterized in that the fixed contact (17) is secured to at least two rigid current conductors (13, 14), which are substantially coaxial with the electrode rod (11) and electrode (10) and extend downwardly through the vacuum chamber (1) and past the tilting crucible (9), and in that the current conductors are spaced from each other to such extent that the tilting crucible can be tilted between them into the casting position.

2. A furnace according to claim 1, characterized in that the coaxial current conductors (13, 14) are interconnected, below the tilting crucible (9), by a transverse member (6), which is substantially parallel to the axis of tilt and in which the fixed contact (17) is arranged, and in that the movable co-operating contact (19) can be moved laterally into engagement with the fixed contact by means of the tilting crucible (9) when the crucible is swung into the melting position.

3. A furnace according to claims 1 and 2, characterized in that a cooling duct system (18) extends through the current conductors (13, 14) including the transverse member (16).

4. A furnace according to claims 1 and 2, characterized in that the fixed contact (17) is also a means for limiting the swing of the tilting crucible (9).

5. A vacuum arc melting and casting furnace, comprising:

(a) a vacuum chamber;

(b) a crucible in the vacuum chamber;

(c) means tiltably supporting the crucible in the vacuum chamber for pouring out the contents thereof;

(d) an electrode extendable downwardly into the crucible coaxially thereof when the crucible is not tilted;

(e) a first electrical contact projecting from the bottom of the crucible; and (f) a second, rigid electrical contact means fixed in the vacuum chamber for electrical connection with the first electrical contact when the crucible is not tilted and separation therefrom when the crucible is tilted.

6. A furnace according to claim 5, wherein the second electrical contact means additionally comprises at least two rigid current conductors which extend downwardly through the vacuum chamber outside the tilting arc of the crucible, the axis of the at least two conductors being substantially coaxial with the electrode.

7. A furnace according to claim 5, and additionally comprising a cooling duct system extending through the second electrical contact means.

8. A furnace according to claim 5, 6 or 7, wherein the second electrical contact means comprises a transverse member fixedly extending substantially parallel to the axis of tilt of the crucible and an electrical contact on the transverse member for the electrical connection with the first electrical contact projecting from the crucible.

9. A furnace according to claim 5, 6 or 7, wherein the second electrical contact means additionally comprises means for limiting the tilt of the crucible in one direction.

10. A furnace according to claim 9, wherein the means tiltably supporting the crucible are offset from the center of gravity of the crucible in such a way that gravity tilts the crucible into the second electrical contact means.

* * * * *